US007503780B1

(12) United States Patent
Huang

(10) Patent No.: US 7,503,780 B1
(45) Date of Patent: Mar. 17, 2009

(54) USB FLASH DISK WITH COVER

(75) Inventor: Joseph Huang, Tao-Yuan Hsien (TW)

(73) Assignee: HO E Screw & Hardware Co., Ltd., Taoyuan (TW)

( * ) Notice: Subject to any disclaimer, the term of this patent is extended or adjusted under 35 U.S.C. 154(b) by 0 days.

(21) Appl. No.: 12/019,376

(22) Filed: Jan. 24, 2008

(51) Int. Cl.
*H01R 13/44* (2006.01)

(52) U.S. Cl. ..... 439/135; 439/358

(58) Field of Classification Search ..... 439/135, 439/149, 353, 358, 660; 361/752, 737; 710/72–73
See application file for complete search history.

(56) References Cited

U.S. PATENT DOCUMENTS 7,165,998 B2 * 1/2007 Lee et al. ..... 439/660
7,341,464 B2 * 3/2008 Cuellar et al. ..... 439/135
7,364,445 B1 * 4/2008 Ni et al. ..... 439/140
7,394,611 B1 * 7/2008 Rahgozar ..... 360/75
7,416,424 B1 * 8/2008 Deckman ..... 439/135

* cited by examiner

*Primary Examiner*—Khiem Nguyen
(74) *Attorney, Agent, or Firm*—Ming Chow; Sinorica, LLC

(57) ABSTRACT

A USB flash disk with an upper cover mainly formed at least on one side of a housing thereof a cut, an outer housing is slipped over the aforesaid housing and covers the cut with one lateral side of it, the lateral side has therein in corresponding with that of the cut at least an elastic sheet at a position, a bottom end of the elastic sheet is fixed on the lateral side, while an upper end of the elastic sheet has a protruding hook protruding out of the top edge of the lateral side, and the elastic sheet has a pressing portion protruding out of the outer surface of the lateral side; the upper cover is put on the upper side of the housing, and has an engaging hole on its side in opposition to the cut to be hooked by the protruding hook when the pressing portion is not pressed, and is released from hooking when the pressing portion is pressed to allow separation of the upper cover from the USB flash disk.

10 Claims, 6 Drawing Sheets

USB FLASH DISK WITH COVER

BACKGROUND OF THE INVENTION

1. Field of the Invention

The present invention relates to a brand new structure of a USB flash disk, and especially to a USB flash disk with an upper cover for tightly covering.

2. Description of the Prior Art

A USB flash disk uses a flash memory and a Universal serial bus (USB) connector for connecting to a computer for access of data, and for carrying on one's person, it is quite convenient for use, and has been widely used by people.

A conventional USB flash disk has in its structure an exposed Universal serial bus connector on a housing having therein an electric circuit board, in order to protect the Universal serial bus connector when it is not connected with a computer; a closable upper cover is added for it. The upper cover prevents dropping of the Universal serial bus connector by tightly combining with the latter. However, such an upper cover is hard to draw for opening if the combining is too tight; and is unable to be tightly covered and thus is dropped if the combining is too loose; and after using for a long time, the tight combining will be loosened, hence a defect of inconvenience in using the upper cover often exists, thereby improvement is required.

SUMMARY OF THE INVENTION

The main object of the present invention is to provide a USB flash disk with an upper cover, in which some designing in mechanism is provided between the USB flash disk and the upper cover, in order that the upper cover is not subjected to self dropping from the USB flash disk, thereby a function of protecting the upper cover can be obtained. And the mechanism is simple for operating, and a user is very easy to remove the upper cover from the USB flash disk for use.

Therefore, the USB flash disk with the upper cover provided by the present invention mainly is formed at least on one side of a housing of the USB flash disk a cut; and an outer housing is slipped over the aforesaid housing and covers the cut with one lateral side of it, the lateral side has therein at least an elastic sheet at a position in corresponding with that of the cut, the bottom end of the elastic sheet is fixed on the lateral side, while an upper end of the elastic sheet is provided with a protruding hook that protrudes out of the top edge of the lateral side, and the elastic sheet has a pressing portion protruding out of the outer surface of the lateral side; further, the upper cover can be put on the upper side of the housing of the USB flash disk, and has an engaging hole on its side in opposition to the cut, the engaging hole is hooked by the protruding hook when the pressing portion is not pressed, and is released from being hooked when the pressing portion is pressed to allow separation of the upper cover from the USB flash disk.

The wherein another side of the outer housing of the USB flash disk with the upper cover provided by the present invention can be provided on both its lateral sides each with a hook identical to each other, or can be provided on one of the two sides with a pivot structure for pivotally connecting the upper cover with the outer housing.

And more, of the USB flash disk with the upper cover provided by the present invention, the upper cover can be provided thereon with an engaging structure which can be engaged on a belt like member to prevent the upper cover from being subjected to losing.

The present invention will be apparent in its structural features and function of operation after reading the detailed description of the preferred embodiment thereof in reference to the accompanying drawings.

DETAILED DESCRIPTION OF THE PREFERRED EMBODIMENT

Figure 1:
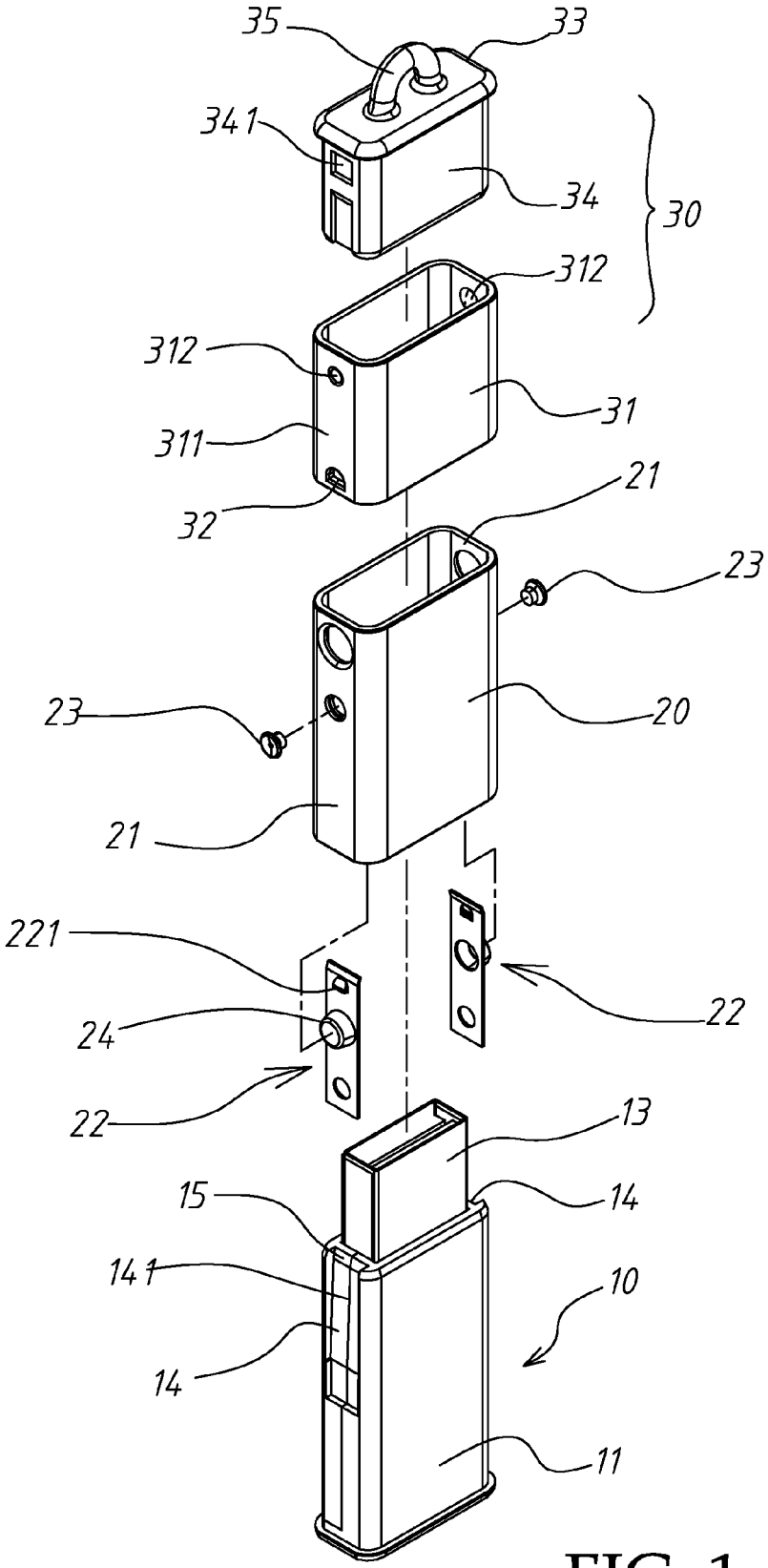
FIG. 1 is an anatomic perspective view of a first embodiment of the present invention.

Referring to FIGS. 1-4 showing a first embodiment of the present invention, the embodiment is composed of a USB flash disk 10, an outer housing 20 and an upper cover 30.

The USB flash disk 10 has a housing 11, the housing 11 has therein a printed circuit board 12 (referring to FIG. 4), the printed circuit board 12 has thereon a flash memory (not shown) and a Universal serial bus connector 13 extending out of the top surface of the housing 11. The housing 11 is formed on each of its lateral sides a cut 14 indented inwardly, the cut 14 is formed on its bottom a bevel surface 141 inclined inwardly (referring to FIG. 4).

The outer housing 20 is slipped over the housing 11 and covers the cuts 14 with two lateral sides 21 of it, each lateral side 21 has therein an elastic sheet 22 at a position in corresponding with one of the cuts 14; the bottom end of each elastic sheet 22 is riveted by a rivet 23 extending in from outside of its corresponding lateral side 21 and is fixed on the lateral side 21; while an upper end of each elastic sheet 22 is provided with a protruding hook 221 that protrudes out of the top edge of its corresponding lateral side 21, and the elastic sheet 22 has a pressing portion 24 protruding out of the outer surface of the lateral side 21; the protruding hook 221 can be shaken and displaced in its corresponding cut 14 when the pressing portion 24 is pressed.

The upper cover 30 is put on the upper side of the housing 11 of the USB flash disk 10 to cover the Universal serial bus connector 13, and has two engaging holes 32 on its two lateral sides 311 being each in opposition to a cut 14; each engaging hole 32 is hooked by one protruding hook 221 when the pressing portion 24 is not pressed, and is released from being hooked when the pressing portion 24 is pressed to remove the protruding hook 221 from engaging the engaging hole 32, so as to allow separation of the upper cover 30 from the housing 11 of the USB flash disk 10.

Referring to FIG. 1, the upper cover 30 has a top surface 33, an inner cover 34 is extended down from the top surface 33, and an outer cover 31 covers the inner cover 34, the engaging holes 32 are provided on the lateral sides 311 of the outer cover 31. The inner cover 34 is formed on each of its two lateral sides a hole 341, the outer cover 31 is formed on its two inner lateral sides two protrusions 312 in opposition to the two holes 341, the two protrusions 312 are engaged respectively in the two holes 341 in order that the outer cover 31, the inner cover 34 and the top surface 33 form a sealing state when being assembled; the bottom of the inner cover 34 is tightly slipped over two top bevel portions 15 of the housing 11 of the USB flash disk 10.

Figure 2:
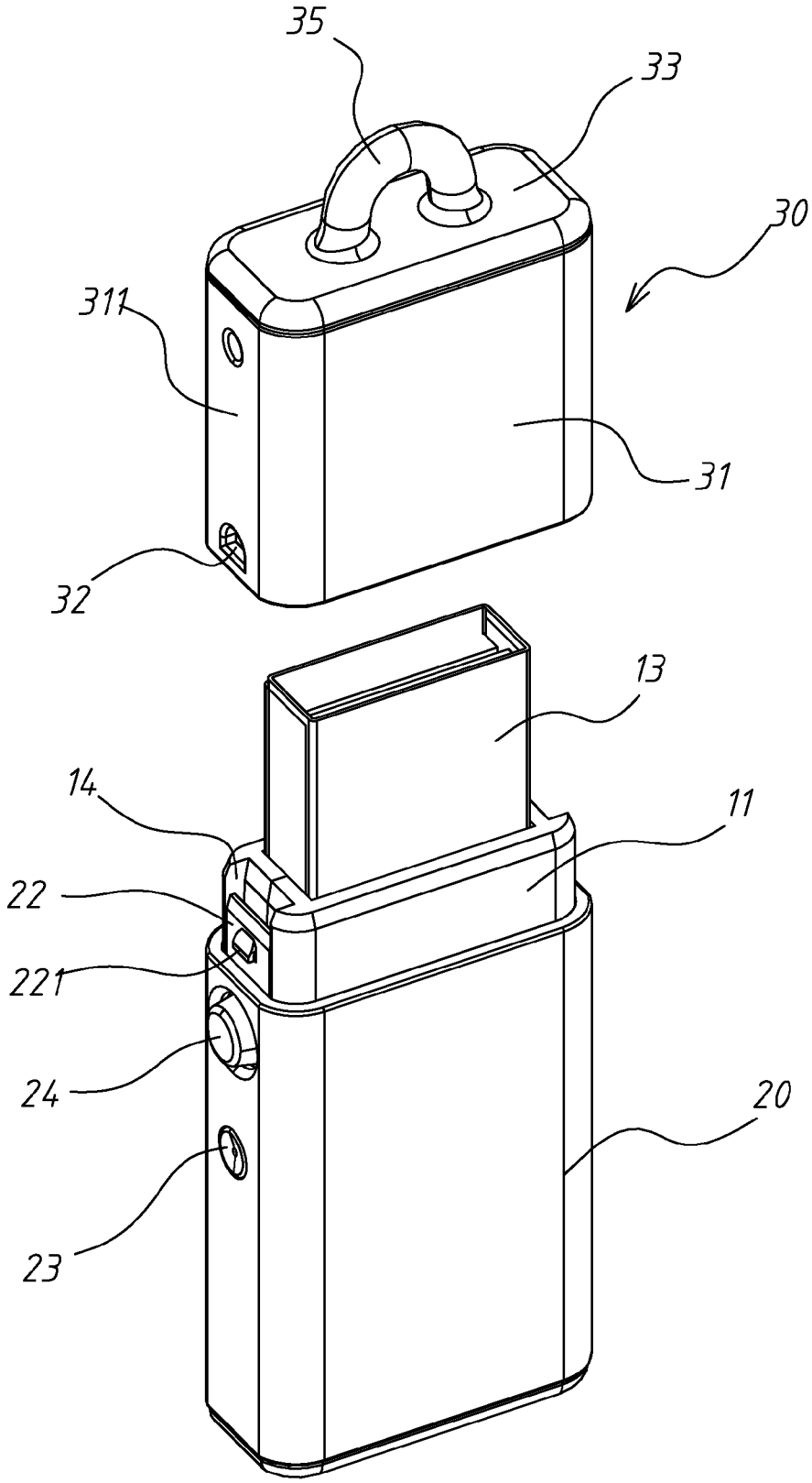
FIG. 2 is a perspective schematic view showing the embodiment of FIG. 1 is partly assembled.
Figure 3:
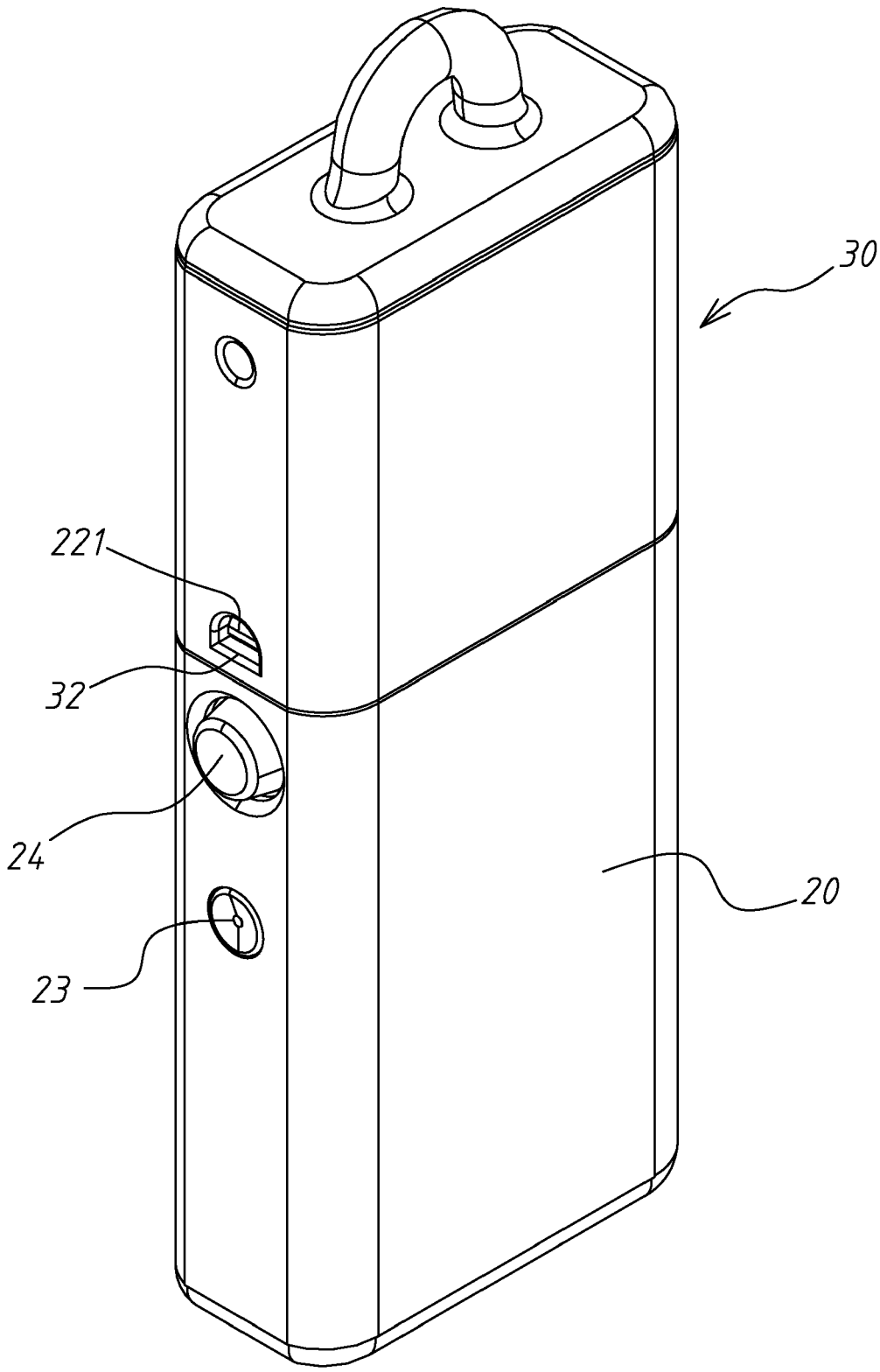
FIG. 3 is a perspective schematic view showing the embodiment of FIG. 1 is totally assembled.
Figure 4:
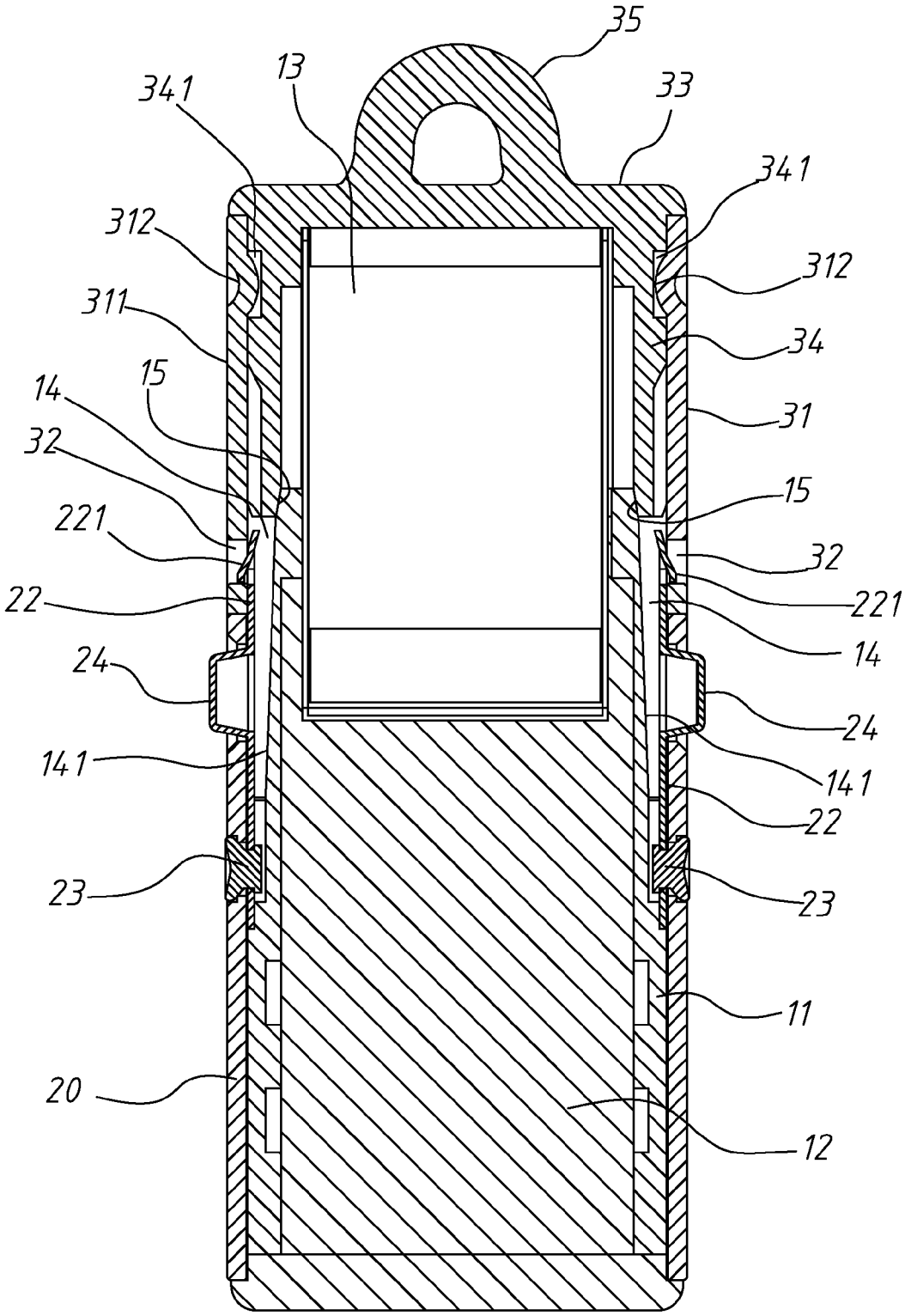
FIG. 4 is a sectional view of the embodiment of FIG. 1.
Figure 5:
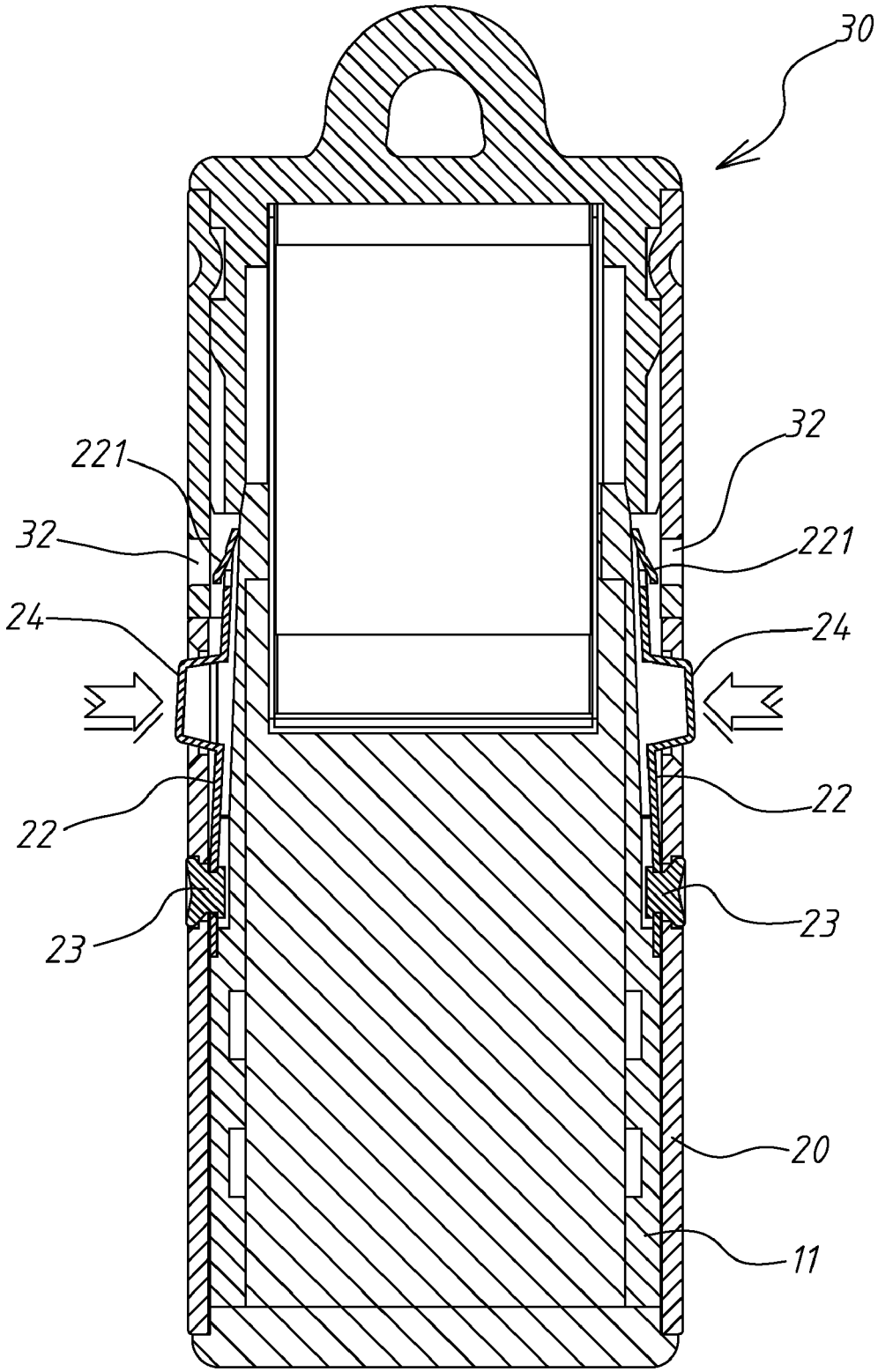
FIG. 5 is a sectional view showing operation of the embodiment of FIG. 1.

When the USB flash disk 10 is not in use, the upper cover 30 can be put on for covering as is shown in FIG. 3; when in use, the pressing portion 24 can be pressed as is shown with the arrows in FIG. 5, so that the upper ends of the elastic sheets 22 move toward the bevel surfaces 141 on the bottoms of the cuts 14 respectively, so that the upper ends of the protruding hooks 221 are released from engaging with the engaging holes 32 of the upper cover 30, at this time, the upper cover 30 can be easily drawn off the USB flash disk 10. As shown in FIG. 2, the USB flash disk 10 can be inserted in a computer for access of data. When it is to cover back the upper cover 30, it needs only to slide the upper cover 30 along the Universal serial bus connector 13 for this. As shown in FIG. 3, the protruding hooks 221 in the shape of half an arrow each can be slid into the engaging holes 32 of the upper cover 30 to firmly assemble the upper cover 30 on the USB flash disk 10.

The upper cover 30 of the present invention can be firmly engaged on the USB flash disk 10 without accidental dropping off, it is extremely convenient for use, and can provide better protecting function for the USB flash disk 10.

Figure 6:
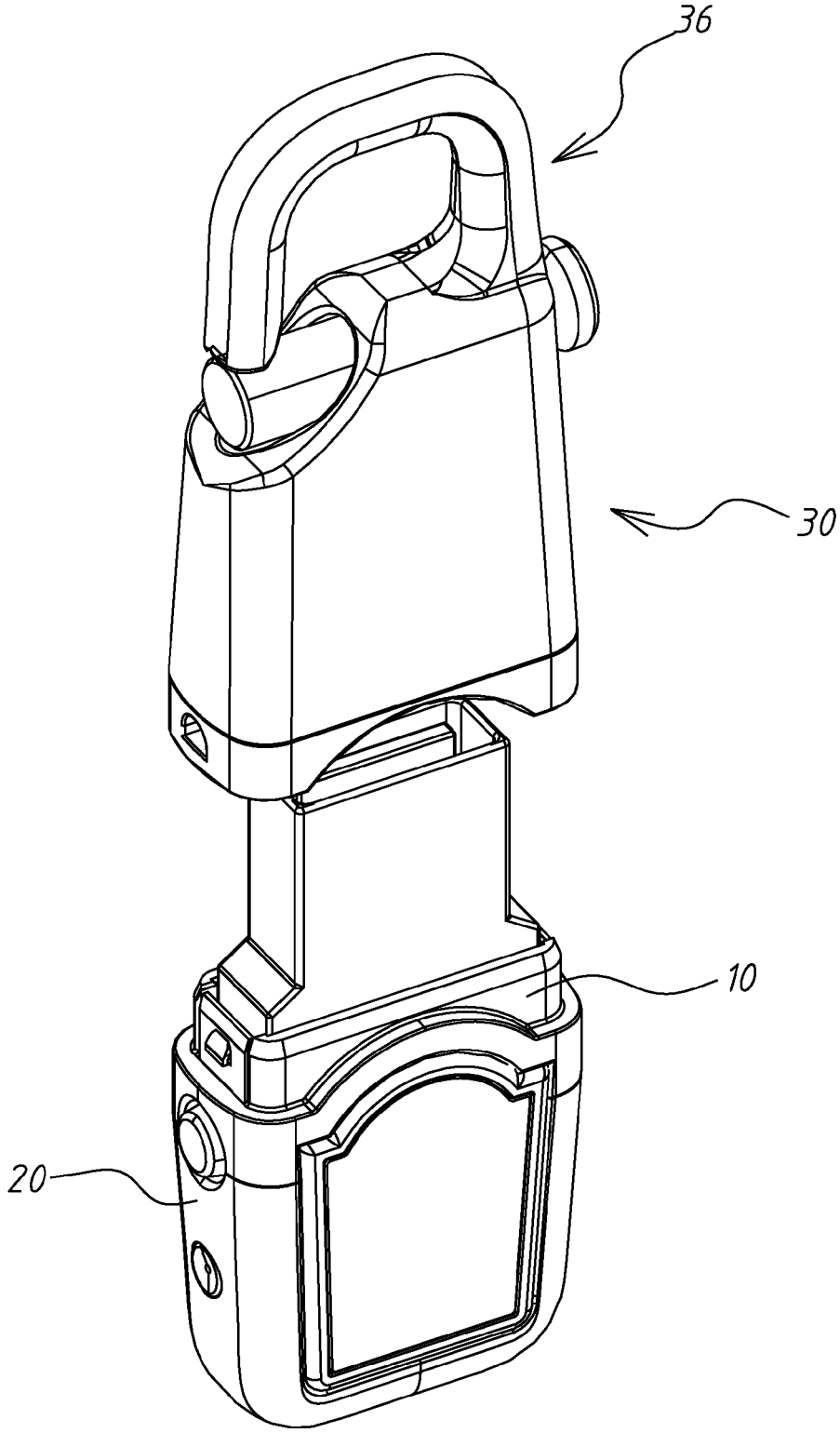
FIG. 6 is a perspective view showing the appearance of a second embodiment of the present invention.

The upper cover 30 is formed on its top surface a semicircular member 35 to be connected with some other article by using a line, a chain or an engaging means. Surely, it can also be like what is depicted in FIG. 6, the top of the upper cover 30 is provided with an engaging member 36, in order that the upper cover 30 is conveniently engaged on an article like a thin belt, for example, a binding belt on a pair of trousers. In this way, the upper cover 30 is not subjected to having the problem of losing.

In conclusion, the USB flash disk with the upper cover provided by the present invention is more advanced in using and operation as well as safety than the conventional technique.

Having thus described the present invention which meets the conditions of patentability, what I claim as new and desire to be secured by Letters Patent of the United States are:

1. A USB flash disk with an upper cover comprising:

a USB flash disk having a housing, said housing having therein a printed circuit board, said printed circuit board having thereon a flash memory and a Universal serial bus connector extending out of a top surface of said housing; said housing is formed on at least one of its lateral sides a cut indented inwardly;

an outer housing slipped over said housing and covering said cut with one lateral side of it, said lateral side having therein an elastic sheet at a position in corresponding with said cut; a bottom end of said elastic sheet being fixed on said lateral side; while an upper end of said elastic sheet being provided with a protruding hook that protrudes out of a top edge of said lateral side, and said elastic sheet having a pressing portion protruding out of an outer surface of said lateral side; said protruding hook being shaken and displaced in said cut when said pressing portion being pressed; and an upper cover put on an upper side of said housing of said USB flash disk to cover said Universal serial bus connector, and having an engaging hole on one of its lateral sides being in opposition to said cut; said engaging hole being hooked by said protruding hook when said pressing portion being not pressed, and being released from hooking when said pressing portion being pressed to remove said protruding hook from engaging said engaging hole, so as to allow separation of said upper cover from said housing of said USB flash disk.

2. The USB flash disk with an upper cover as claimed in claim 1, wherein said lateral side of said outer housing has a rivet, a bottom end of said elastic sheet is riveted by said rivet and thus is fixed.

3. The USB flash disk with an upper cover as claimed in claim 1, wherein said cut on said housing of said USB flash disk is formed on its bottom a bevel surface inclined inwardly.

4. The USB flash disk with an upper cover as claimed in claim 1, wherein said upper cover is formed on its top surface a semicircular member.

5. The USB flash disk with an upper cover as claimed in claim 1, wherein said upper cover has a top surface, an inner cover is extended down from said top surface, and said outer cover covers said inner cover, said engaging hole is provided on said one of said lateral sides of said outer cover.

6. The USB flash disk with an upper cover as claimed in claim 5, wherein said inner cover is formed on each of its two lateral sides a hole, said outer cover is formed on its two inner lateral sides two protrusions in opposition to said two holes, said two protrusions are engaged respectively in said two holes.

7. The USB flash disk with an upper cover as claimed in claim 5, wherein a bottom of said inner cover is tightly slipped over two top bevel portions of said housing of said USB flash disk.

8. The USB flash disk with an upper cover as claimed in claim 1, wherein said housing of said USB flash disk is formed on other one of said lateral sides an identical cut, another elastic sheet is provided on said outer cover at an opposite position to said first mentioned elastic sheet, and said upper cover is provided at an opposite position to said first mentioned engaging hole with another identical engaging hole.

9. The USB flash disk with an upper cover as claimed in claim 1, wherein another side of said outer housing in opposition to said one of said lateral sides having said elastic sheet is provided with a pivot structure for pivotally connecting said upper cover.

10. The USB flash disk with an upper cover as claimed in claim 1, wherein said upper cover is provided thereon with an engaging structure.

* * * * *